United States Patent [19]

Takano

[11] Patent Number: 4,825,755

[45] Date of Patent: May 2, 1989

[54] PISTON-STROKE ADJUSTING MECHANISM OF HYDRAULIC TOOL

[75] Inventor: Hiroji Takano, Matsumoto, Japan

[73] Assignee: Izimi Products Company, Matsumoto, Japan

[21] Appl. No.: 41,482

[22] Filed: Apr. 23, 1987

[51] Int. Cl.[4] ..... F01B 31/14; F15B 15/24

[52] U.S. Cl. ..... 92/13.6; 92/13; 83/639; 30/180; 60/477

[58] Field of Search ..... 92/13, 13.6; 60/477; 83/639; 30/180

[56] References Cited

U.S. PATENT DOCUMENTS

| | | | |
|---|---|---|---|
| 2,556,979 | 6/1951 | Purcell | 92/13.6 |
| 3,058,214 | 10/1962 | Mekler | 60/477 |
| 3,080,852 | 3/1963 | Geyer | 92/13.6 |
| 3,626,807 | 12/1971 | Shartzer | 92/13.6 |
| 3,978,884 | 9/1976 | Sundström | 92/13.6 |
| 4,031,619 | 6/1977 | Gregory | 60/477 |
| 4,149,381 | 4/1979 | Meckler | 60/477 |
| 4,206,603 | 6/1980 | Mekler | 60/477 |

FOREIGN PATENT DOCUMENTS

| | | | |
|---|---|---|---|
| 2062890 | 7/1972 | Fed. Rep. of Germany | 83/639 |
| 82807 | 6/1980 | Japan | 92/13.6 |
| 739180 | 10/1955 | United Kingdom | 92/13 |

*Primary Examiner*—Robert E. Garrett
*Assistant Examiner*—Thomas Denion
*Attorney, Agent, or Firm*—Cushman, Darby & Cushman

[57] ABSTRACT

Disclosed is a piston-stroke adjusting mechanism of a hydraulic tool comprising an oil tank, a ram for causing the forced feed of an oil, and a piston permitted to slide by the pressure of a working fluid. The piston is formed with a through bore into which an adjust pin is slidably inserted in a manner that an end thereof is directed toward the bottom of a cylinder. The piston is rotatably mounted with an adapter at its head section. The adapter has a small-diameter portion at one side thereof which is located in the through bore to be connected to the adjust pin.

3 Claims, 4 Drawing Sheets

PISTON-STROKE ADJUSTING MECHANISM OF HYDRAULIC TOOL

BACKGROUND OF THE INVENTION

1. Field of the Invention

The present invention relates to a piston-stroke adjusting mechanism of a hydraulic tool and, more particularly, to a piston-stroke adjusting mechanism thereof which is constructed such that an adjust pin for adjusting the stroke is mounted in a piston in a cylinder.

2. Description of the Prior Art

Conventionally, this type of hydraulic tool includes one which is shown in FIG.4. Specifically, a hydraulic tool 43 has a body 44, at the right side of which there is provided an oil tank 45, and at a substantially central portion of which there are provided a ram cylinder 46 and ram 47 for supplying a working fluid. At a forward portion of the body 44 there is provided a cylinder section 49 containing a piston 48. A stationary head 50 is mounted on a forward end of the tool in such a manner that it is secured to the body 44 integrally.

A grip/handle 51 which is in the form of a hollow cylinder is mounted on the body 44, within which the above-mentioned oil tank 45 is received.

The ram 47 is swingably mounted with a pressurizing handle 52. When the pressurizing handle 52 is swung several times, the oil in the oil tank 45 is allowed to pass through check valves 53 and 54 and thus is supplied to a bottom section of the piston 48 in the cylinder 49. The piston 48 is thereby raised against the biasing force of a spring 55.

As a result, a male die (movable head) 56 fixed on a head section of the piston 48 is caused to slide jointly with the piston 48 toward a female die 57 provided on the stationary head 50, thus permitting the tool to conduct a terminal handling or processing operation.

However, when conducting the terminal processing operation for, for example, electric wires by using the above-mentioned conventional hydraulic tool, it is necessary to replace the head by another head suitable for the diameter of the electric wire to be processed where this diameter has been changed into a smaller one in particular. Since the conventional tool has a fixed stroke of piston, a useless stroke is produced by the time when the male die (movable head) made to move jointly with the piston abuts on the small-diameter wire and grips the same. This means that the pressurizing handle (ram) must unnecessarily be swung by the extent corresponding to said useless stroke. This means that a larger amount of labor than required must be spent, failing to enhance the working efficiency.

SUMMARY OF THE INVENTION

The present invention has been made in view of the above-mentioned problems and the object thereof is to provide a hydraulic tool which is capable of adjusting the piston stroke so as to permit the same to be in conformity with the diameter of, for example, an electric wire, thereby enabling an enhancement of the working efficiency.

To attain the above object, according to the present invention, there is provided a piston-stroke adjusting mechanism of a hydraulic tool comprising an oil tank, a ram for causing the forced feed of an oil and a piston permitted to slide by the pressure of a working fluid, which comprises a through bore formed in the piston, an adjust pin inserted slidably into the through bore in a manner that an end portion thereof is directed toward the bottom of a cylinder, and an adapter rotatably mounted on a head section of the piston, a small-diameter portion of the adapter at one end thereof being connected to the adjust pin.

According to the above-mentioned construction of the piston-stroke adjusting mechanism, the adjust pin connected within the through bore of the piston to the adapter provided at the head section thereof is rotated by rotating the adapter, whereby the end portion thereof is caused to slide toward the bottom of the cylinder. By protruding the adjust pin from an end face of the piston, it is possible to lessen the return of the piston in corresponding relation to the protruded length of the adjust pin, thus shortening the effective stroke of the piston.

DESCRIPTION OF THE PREFERRED EMBODIMENT

Figure 1:
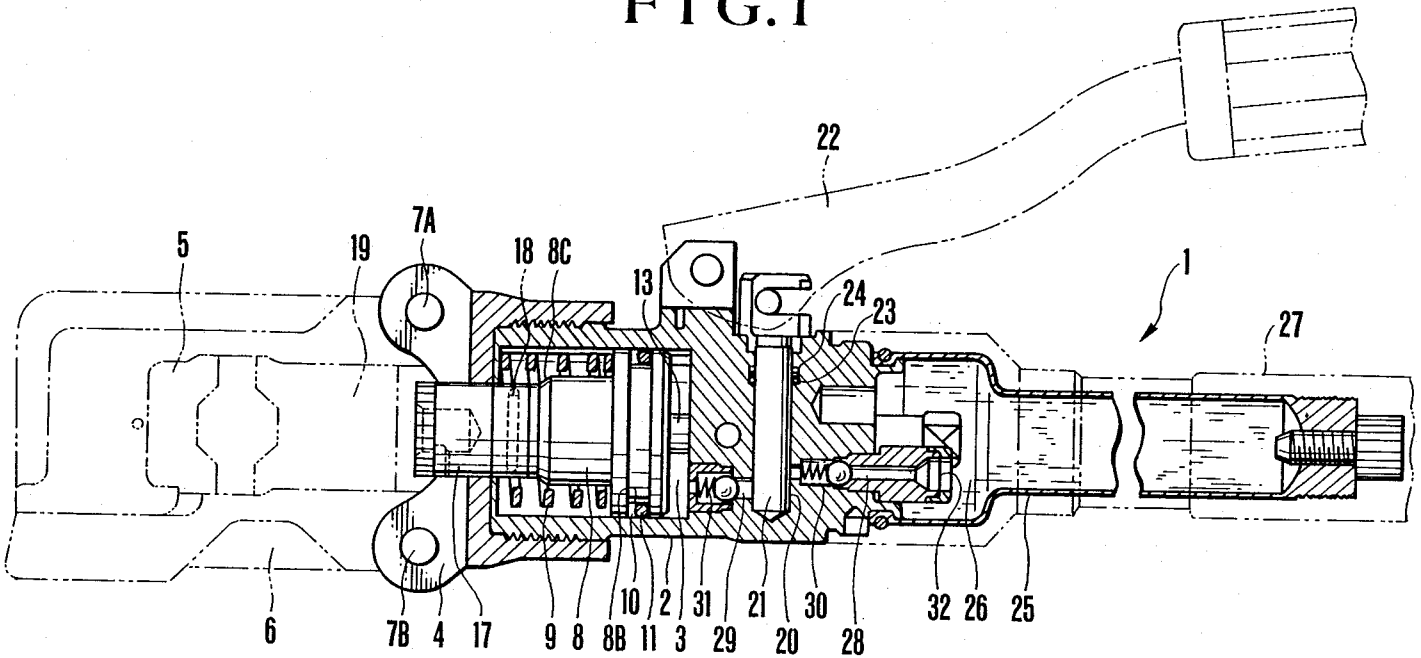
FIG.1 is a longitudinal sectional view of an essential part of a manually operated hydraulic tool illustrated in FIG. 3.
Figure 2:
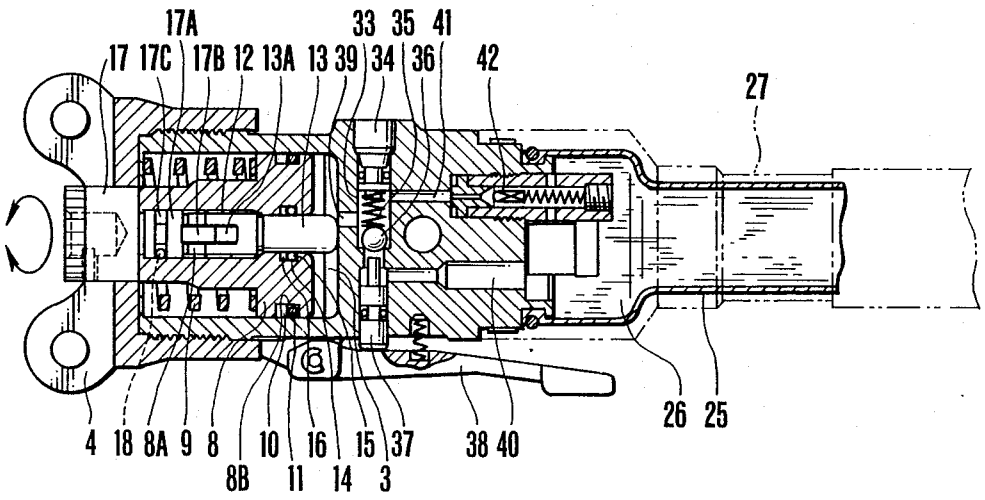
FIG. 2 is a horizontal sectional view thereof.
Figure 3:
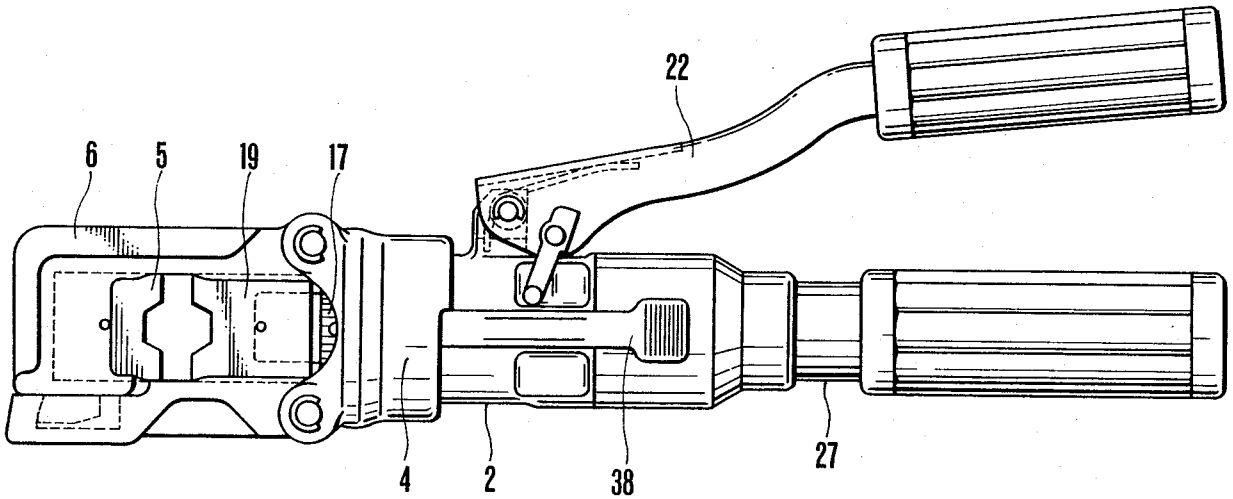
FIG. 3 is a front view of the manually operated hydraulic tool.
Figure 4:
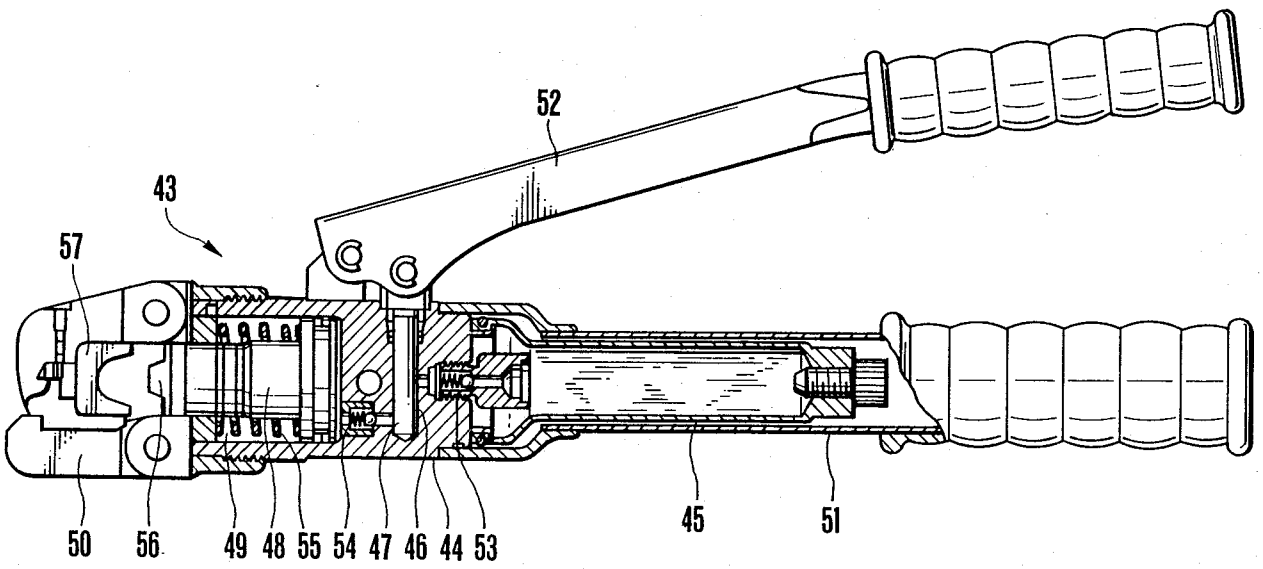
FIG. 4 is a sectional view of an essential part of a conventional manually operated hydraulic tool.

FIG. 1 is a longitudinal sectional view of an essential part of a manually operated hydraulic tool illustrated in FIG. 3. FIG. 2 is a horizontal sectional view thereof. Referring now to FIG. 1, a manually operated hydraulic tool 1 has a body 2, which is formed, at its upper portion (at the left side of the illustration), with a cylinder 3 in a manner that this cylinder 3 is integral with the body 2. At the forward end portion of the cylinder 3, a cylinder head 4 is fitted over the same by means of, for example, screws in a manner that it is closely fitted over an end portion of the cylinder 3. Mounted on the cylinder head 4 by means of pins 7A and 7B is a stationary head 6 having a female die 5 which is indicated in FIG. 1 by two-dot chain lines, as described later. It is to be noted that in this embodiment there is shown an example wherein a head of a compression tool, one of the terminal processing tools, is mounted on the cylinder head 4.

Within the cylinder 3 there is slidably disposed a piston 8 having a large-diameter portion and a small-diameter portion integral therewith, said small-diameter portion being mounted thereover with a return spring 9 in such a manner that one end portion thereof is allowed to abut against an inner end face of the cylinder head 4 while the other end portion thereof is allowed to abut against an end of the large-diameter portion of the piston 8. The large-diameter portion of the piston is formed in its outer periphery with a groove 8B into which there are received a back-up ring 10 and an O-ring 11 for preventing the entry of a working fluid or oil. As shown in FIG. 2, the piston 8 is formed at its central portion with a through bore 8A in the inner peripheral surface of a substantially middle portion of which an internal thread 12 is provided over a suitable length. Screwed into the internal thread 12 is an adjust pin 13 formed at its head portion with a concave groove 13A in a manner that its tip end is directed toward the bottom of the cylinder 3, whereby the adjust pin 13 can make its reciprocating movement within the through bore 8A along the internal thread 12. It is to be noted here that the through bore 8A is formed in its inner peripheral surface with a groove 14 into which there are received a back-up ring 16 and O-ring 15 for preventing the entry of the oil in such a manner that both rings are allowed to abut against the outer perihery of the adjust pin 13 so as to prevent the leakage of the oil.

On the other hand, an adapter 17 is rotatably provided at the center of the cylinder head 4, i.e., at the forward portion of the piston 8 and its small-diameter portion 17A formed integrally with the adapter 17 is located in the through bore 8A of the piston 8, said small-diameter portion 17A having a convex portion 17B at its tip end portion, said convex portion 17B being fitted into the groove 13A formed at the head portion of the adjust pin 13, whereby the adapter 17 is connected to the adjust pin 13. Accordingly, the adjust pin 13, when the adapter 17 is rotated, is moved, while being rotated, along the internal thread 12 in the rightward or leftward direction. It is to be noted here that the concave groove 13A of the adjust pin 13 fitted over the convex portion 17B of the adapter 17 has of course a fitting dimension which is large enough to prevent the concave portion 13A from being disengaged from the convex portion 17B even when the adjust pin 13 has been moved to the right (toward the lower end of the tool) to the maximum extent. It is also to be noted here that the small-diameter portion 17A of the adapter 17 is formed in its outer periphery with a groove 17C into which a pin 18 is fitted so as to prevent the adapter 17 from being disengaged from the through bore 8A of the piston 8. The adapter 17 is mounted at its head section with a male die (movable head) 19 such as that shown in FIG. 1 by two-dot chain lines, which moves jointly with the piston 8. This male die 19 is paired with the female die 5 provided on the stationary head 6 so as to enable the terminal processing operation to be performed.

Meanwhile, at the substantially central portion of the body 2 of the hydraulic tool there are provided a ram cylinder 20 and a ram 21 inserted thereinto for purpose of supplying the oil, as shown in FIG. 1. At the upper end of the ram 21 there is mounted a pressurizing handle 22 such as that shown in FIG. 2 by two-dot chain lines, the vertical swing operation of which causes the ram 21 to be reciprocatingly moved within the ram cylinder 20, thereby to supply the working oil into the cylinder 3 by the pumping action. The reference numerals 23 and 24 denote an O-ring and a back-up ring which are intended to seal the interspace between the ram cylinder 20 and the ram 21 to thereby prevent the leakage of the working oil. Further, at the right side (the lower portion) of the body 2 of the tool, there is provided an oil tank 25 in which is received an oil 26. At the right side of the body 2 of the tool there is also mounted a hollow member indicated in FIGS. 1 and 2 by two-dot chain lines which serves concurrently both as a grip and a handle 27, in such a manner that it has the oil tank 25 received therein.

The body 2 of the tool is formed with oil passages 28 and 29 for supplying the oil 26 in the oil tank 25 to the cylinder 3, said oil passage 28 allowing the oil tank 25 to communicate with the ram cylinder 20, said oil passage 29 allowing the ram cylinder 20 to communicate with the cylinder 3. Each oil passage 28 or 29 is equipped with a check valve 30 or 31 composed of a spring and a ball so as to prevent the return flow of the oil 26. It is to be noted here that a filter 32 is provided at the oil-tank side of the oil passage 28 so as to filter the oil 26.

Meanwhile, at the substantially central portion of the tool body 2 in the proximity of the ram cylinder 20, there is provided a valve chamber 33 concurrently serving as an oil passage as shown in FIG. 2, said valve chamber 33 being closed at one end by being screwed thereinto with a plug 34. Within the valve chamber 33 there is received a return valve composed of a spring 35 and a ball 36. Against the ball 36 there abuts a tip end of a depression pin 37 fitted into the other end portion of the valve chamber 33, whereby the valve is opened by depression of the ball 36. The other end portion of the depression pin 37 is allowed to protrude outside the body 2 to abut against a return lever 38. The valve chamber 33 is communicated with the cylinder 3 by way of an oil passage 39 and is also communicated with the oil tank 25 by way of an oil passage 40. Accordingly, when the return lever 38 is depressed and the ball 36 is thereby depressed to open the return valve, the working oil in the cylinder 3 is returned to the oil tank 25. Further, a bypass oil passage 41 is provided between the valve chamber 33 and the oil tank 25 and this bypass passage is equipped with a relief valve 42 so as to permit the working oil to be released into the oil tank 25 when the working oil in the cylinder 3 has increased up to a level higher than specified.

The action of this embodiment will now be described. When in FIG. 1 the pressurizing handle 22 is swung, the ram 21 is caused to slide within the ram cylinder 20 vertically of the illustration. During the upward stroke of the ram 21, the interior of the ram cylinder 21 is vacuumized to a negative pressure. As a result, the check valve 30 is opened due to the pressure difference between the oil tank and the ram cylinder, so that the oil 26 in the oil tank 25 is allowed to flow into the ram cylinder 20.

In the downward movement of the ram 21, the check valve 30 closes the oil passage 28 and at the same time the check valve 31 is opened. As a result, the oil in the ram cylinder 20 is forcibly fed into the cylinder 3 by way of the oil passage 29. By repeating the swing operation of the pressurizing handle 22 several times, the pressure of the working oil in the cylinder 3 is increased by degrees, so that the piston 8 is pushed upward (leftward of the illustration) against the biasing force of the spring 9. For this reason, the movable head 19 is also pushed upward jointly with the adapter 17 provided at the forward end of the piston 8. It is to be noted here that the stroke of the piston 8 becomes maximum when the small-diameter portion end 8C of the piston 8 has abutted on the inner end face of the cylinder head 4.

When the return lever 38 shown in FIG. 2 is depressed upon completion of the terminal processing operation performed with the movable head 19 raised at its upward position, the depression pin 37 is depressed and at the same time the ball 36 is also depressed to open the oil passage of the valve chamber 33. As a result, the working oil in the cylinder 3 is returned, due to a forced return of the piston 8 by the biasing force of the spring 9, to the oil tank 25 by way of the oil passages 39 and 40.

Meanwhile, the piston 8 can have its stroke adjusted by the adjust pin 13. This adjustment is made by protruding the adjust pin 13 from the end face of the piston 8. More specifically, when the adapter 17 is rotated clockwise (in the rightward direction) with the piston 8 located at its raised position, the adjust pin 13 is rotated along the internal thread 12 to project from the end face of the piston 8 because it is connected to the convex portion 17B formed at the tip end portion of the adapter 17. Accordingly, when the piston 8 is moved downwards by operation of the return lever 38, the adjust pin 13 is caused to abut against the bottom of the cylinder 3. That is, the piston 8 fails to return in the amount corresponding to the protruded length of the adjust pin 13, so that the effective stroke of the piston 8 is shortened correspondingly. In consequence, when the working oil is next supplied from the oil tank to the cylinder 3, it is possible to bring the movable head 19 nearly to the female die 5 of the stationary head 6 with reduced operation frequencies of the pressurizing handle 22. Accordingly, it is also possible to bring the movable head 19 earlier to a material to be processed as well, thereby completing the terminal processing operation earlier than otherwise.

On the contrary, when the adapter 17 is rotated counterclockwise (in the leftward direction), the adjust pin 13 is received within the piston 8, whereby the piston has its maximum stroke when the end face of the adjust pin 13 becomes flush with the end face of the piston 8.

As described above, it is possible to optionally vary the stroke of the piston 8 by means of the adjust pin 13. Therefore, the piston 8 can be easily adjusted to a minimum necessary stroke even when the head of the tool is replaced by, for example, a hydraulic cutter or a stripper, or another head having a gripping surface area different from that of the present head.

The present invention is of course not limited to the above-mentioned manually operated hydraulic tool.

As apparent from the foregoing description, according to the piston-stroke adjusting mechanism of the invention, it is possible to easily perform the adjustment of the piston stroke without using any special adjusting tool therefor. Further, it is possible to adjust the piston to a minimum necessary stroke where, for example, the tool head has been replaced by another one. Therefore, the piston has no useless stroke, so that the frequency with which the pressurizing handle is operated is reduced. This eliminates the necessity of using a larger amount of labor than required and, at the same time, shortens the time period in which the operation is performed, thus enhancing the working efficiency.

What is claimed is:

1. An apparatus for piston-stroke adjustment of a hydraulic tool having a moveable head which uses a liquid fluid comprising:

reservoir means for storing said liquid fluid;

a cylinder having an internal bore extending from a top toward said end portion;

a piston which is slidably moveable within said internal bore of said cylinder, said piston further having a through bore, a head section at one end of said piston, and an end portion at another end of said piston;

means for feeding said liquid fluid under pressure into said internal bore to increase pressure in said cylinder behind the bottom of said piston to cause pressure to build up on said end portion of said piston and movement of said piston toward said top of said cylinder;

means for releasing said fluid pressure;

means for returning said end portion of said piston to the bottom of said cylinder after said fluid pressure is released;

a slidable adjustment pin inserted through said through bore so that an end of said adjustment pin is directed toward and protrudes through the end portion of said piston to prevent said end portion of said piston from returning to the bottom of cylinder bore when said returning means acts upon said piston;

adapted means adjustably connected to said head section of said piston and connected to said adjustment pin for adjusting a distance that said end of said adjustment pin protrudes from said end portion of said piston to adjust the stroke of said piston.

2. An apparatus according to claim 1 wherein said means for feeding said liquid fluid includes:

a ram cylinder disposed between said reservoir means and said cylinder, a ram disposed within said ram cylinder, and a hand-operated hydraulic lever connected to said ram for driving said ram.

3. An apparatus according to claim 1 wherein said returning means is a spring.

* * * * *